US008355297B2

(12) United States Patent
Wilbur et al.

(10) Patent No.: US 8,355,297 B2
(45) Date of Patent: Jan. 15, 2013

(54) WATCH ASSEMBLY HAVING A PLURALITY OF TIME-COORDINATED BELTS

(75) Inventors: Jason M. Wilbur, Pasadena, CA (US); Jeffrey J. Stephenson, Big Bear City, CA (US)

(73) Assignee: Devon Works, LLC, Grand Rapids, MI (US)

( * ) Notice: Subject to any disclaimer, the term of this patent is extended or adjusted under 35 U.S.C. 154(b) by 252 days.

(21) Appl. No.: 12/940,941

(22) Filed: Nov. 5, 2010

(65) Prior Publication Data

US 2011/0103195 A1 May 5, 2011

Related U.S. Application Data

(60) Provisional application No. 61/258,536, filed on Nov. 5, 2009.

(51) Int. Cl.
*G04B 19/20* (2006.01)

(52) U.S. Cl. ..... 368/78; 368/223

(58) Field of Classification Search ..... 368/25, 368/40, 78, 223, 52, 56
See application file for complete search history.

(56) References Cited

U.S. PATENT DOCUMENTS

| | | | | |
|---|---|---|---|---|
| 1,998,763 | A * | 4/1935 | Janson | 368/78 |
| 2,072,457 | A * | 3/1937 | Larrabee | 368/56 |
| 2,645,896 | A * | 7/1953 | Uhlig et al. | 368/222 |
| 2,790,300 | A * | 4/1957 | Lux | 368/40 |
| 2,930,183 | A | 3/1960 | Nusslé | |
| 2,952,967 | A | 9/1960 | Nusslé | |
| 3,024,590 | A | 3/1962 | Wynne | |
| 3,329,880 | A | 7/1967 | Boyles | |
| 3,597,918 | A * | 8/1971 | Robinson | 368/222 |
| 3,662,535 | A * | 5/1972 | Hedrick et al. | 368/112 |

(Continued)

FOREIGN PATENT DOCUMENTS

CH 338150 A 4/1959

(Continued)

OTHER PUBLICATIONS

Notification of the Transmittal of the International Search Report and the Written Opinion of the International Searching Authority, or the Declaration dated Apr. 29, 2011 for corresponding International Application No. PCT/US2010/055732 dated Nov. 5, 2010; total pp. 16.

(Continued)

*Primary Examiner* — Sean Kayes
(74) *Attorney, Agent, or Firm* — Connolly Bove Lodge & Hutz LLP

(57) ABSTRACT

A watch for providing a digital time display comprises a movement mechanism disposed in a case that includes a number of continuous belts. The belts each have a numerical indicia consistent with hours, minutes and optionally second. The belts mounted over opposed drums, and the drums are rotated through gear engagement motors to move the belts. The arrangement of belts and drums are mounted on a frame separate from the case. The motors are operated to move the belts to cause the numerical indicia of the combined belts to register with one or more windows visible through a transparent cover to provide a time display. The belts may be oriented to overlap one another. The watch includes a microcontroller for controlling the operation of the motors, an optical sensor to determining the position of the belts, and a wirelessly rechargeable battery pack for powering the motors.

27 Claims, 14 Drawing Sheets

U.S. PATENT DOCUMENTS

| | | | | |
|---|---|---|---|---|
| 3,747,321 | A | 7/1973 | Yudewitz | |
| 3,852,949 | A * | 12/1974 | Sayler | 368/76 |
| 3,979,898 | A | 9/1976 | Werres | |
| 4,103,484 | A * | 8/1978 | Bailey | 368/76 |
| 4,162,609 | A | 7/1979 | Oishi et al. | |
| 4,357,691 | A | 11/1982 | Goodchild | |
| 4,611,161 | A | 9/1986 | Barker | |
| 4,873,677 | A | 10/1989 | Sakamoto et al. | |
| 4,972,392 | A * | 11/1990 | Wang | 368/21 |
| 5,299,178 | A * | 3/1994 | Belik | 368/76 |
| 5,331,609 | A * | 7/1994 | Gubin | 368/223 |
| 5,644,207 | A | 7/1997 | Lew et al. | |
| 5,949,214 | A | 9/1999 | Broussard et al. | |
| 6,016,046 | A | 1/2000 | Kaite et al. | |
| 6,040,680 | A | 3/2000 | Toya et al. | |
| 6,208,115 | B1 | 3/2001 | Binder | |
| 6,498,455 | B2 | 12/2002 | Zink et al. | |
| 6,608,464 | B1 | 8/2003 | Lew et al. | |
| 6,636,017 | B2 | 10/2003 | Zink et al. | |
| 6,661,197 | B2 | 12/2003 | Zink et al. | |
| 7,164,255 | B2 | 1/2007 | Hui | |
| 7,495,414 | B2 | 2/2009 | Hui | |
| 7,511,452 | B2 | 3/2009 | Bersenev | |
| 7,567,514 | B2 | 7/2009 | Kobayashi et al. | |
| D631,375 | S * | 1/2011 | Wilbur | D10/38 |
| 2005/0083787 | A1 | 4/2005 | Perez et al. | |
| 2005/0122844 | A1 | 6/2005 | Ruchonnet | |
| 2005/0189906 | A1 | 9/2005 | Sun | |
| 2006/0145660 | A1 | 7/2006 | Black et al. | |
| 2007/0182367 | A1 | 8/2007 | Partovi | |
| 2008/0061735 | A1 | 3/2008 | Toya et al. | |
| 2008/0079392 | A1 | 4/2008 | Baarman et al. | |
| 2008/0185989 | A1 | 8/2008 | Stenroos et al. | |
| 2009/0033280 | A1 | 2/2009 | Choi et al. | |
| 2009/0102419 | A1 | 4/2009 | Gwon et al. | |
| 2009/0128086 | A1 | 5/2009 | Lee | |
| 2009/0134837 | A1 | 5/2009 | Bersenev | |
| 2009/0153098 | A1 | 6/2009 | Toya et al. | |
| 2009/0161496 | A1 | 6/2009 | Gerber et al. | |
| 2009/0267560 | A1 | 10/2009 | Toya et al. | |

FOREIGN PATENT DOCUMENTS

| | | | |
|---|---|---|---|
| FR | 1191806 | A | 10/1959 |
| FR | 1395203 | A | 4/1965 |
| FR | 2726099 | A1 | 4/1996 |

OTHER PUBLICATIONS

PCT Invitation to Pay Additional Fees (PCT/ISA/206) and Partial International Search (Annex) for corresponding International Application No. PCT/US2010/055732 dated Feb 22, 2011; total 5 pages.

* cited by examiner

WATCH ASSEMBLY HAVING A PLURALITY OF TIME-COORDINATED BELTS

CROSS-REFERENCE TO RELATED APPLICATIONS

This application claims the benefit of U.S. Provisional Application No. 61/258,536 filed Nov. 5, 2009, which is herein incorporated by reference in its entirety.

BACKGROUND OF THE INVENTION

The present disclosure relates to timepieces and, more particularly, to watch assemblies having a face that displays a plurality of time-coordinated belts which indicate the time by hours, minutes and optionally seconds. The time-coordinated belts are preferably configured and arranged in a manner to provide an indication of the time by a digital display.

SUMMARY

In one embodiment, a watch assembly having a plurality of time-coordinated belts is described, wherein at least one of the time-coordinated belts overlaps another of the time-coordinated belts. The watch assembly comprises a casing and a wristband or bracelet. The casing comprises a display, a plurality of time-coordinated belts, and one or more movement mechanisms to actuate the plurality of time-coordinated belts. The display may comprise one or more windows or display frames through which the hour, minutes and optionally seconds are presented to presumably reflect the time and provide a viewable time display. The plurality of time-coordinated belts may separately be indicative of the hour, minutes and seconds and one or more of the belts may be arranged in an overlapping or interwoven configuration so as to provide the indication of hour, minutes and seconds in relatively close proximity to one another so as to resemble a conventional digital display. One or more movement mechanisms actuate the plurality of time-coordinated belts, either separately or in a coordinated manner.

In another embodiment, a watch assembly having a plurality of time-coordinated belts is described, wherein the time-coordinated belts are configured in a substantially parallel and non-overlapping relation to one another. The watch assembly comprises a casing and a wristband or bracelet. The casing comprises a display, a plurality of time-coordinated belts and one or more movement mechanisms to actuate the plurality of time-coordinated belts. The display may comprise one or more windows or display templates through which the hour, minutes and optionally seconds are presented to presumably reflect the time to provide a time display. The windows may be stationary or they may similarly have a movement that is time-coordinated with the belts. The plurality of time-coordinated belts may separately be indicative of the hour, minutes and seconds and one or more of the belts may be arranged in a substantially parallel configuration. One or more movement mechanisms actuate one or both of the plurality of time-coordinated belts and the windows, either separately or in a coordinated manner.

Other objects, features and advantages of the present invention will become apparent to those skilled in the art from the following detailed description.

BRIEF DESCRIPTION OF THE DRAWINGS

Like numerals refer to like parts throughout the several views of the drawings.

DETAILED DESCRIPTION OF THE EMBODIMENTS

A more complete appreciation of the disclosure and many of the attendant advantages may be obtained, as the same becomes better understood by reference to the following detailed description of the exemplary embodiments.

Figure 1:
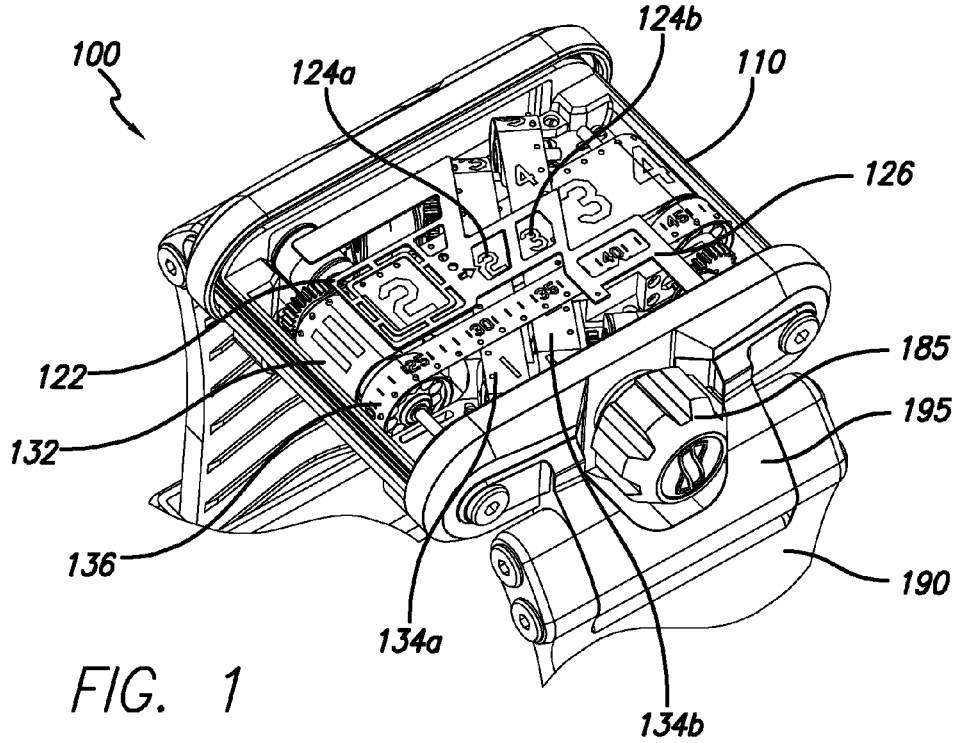
FIG. 1 is a perspective view of an embodiment of a watch assembly having a plurality of time-coordinated belts.
Figure 12:
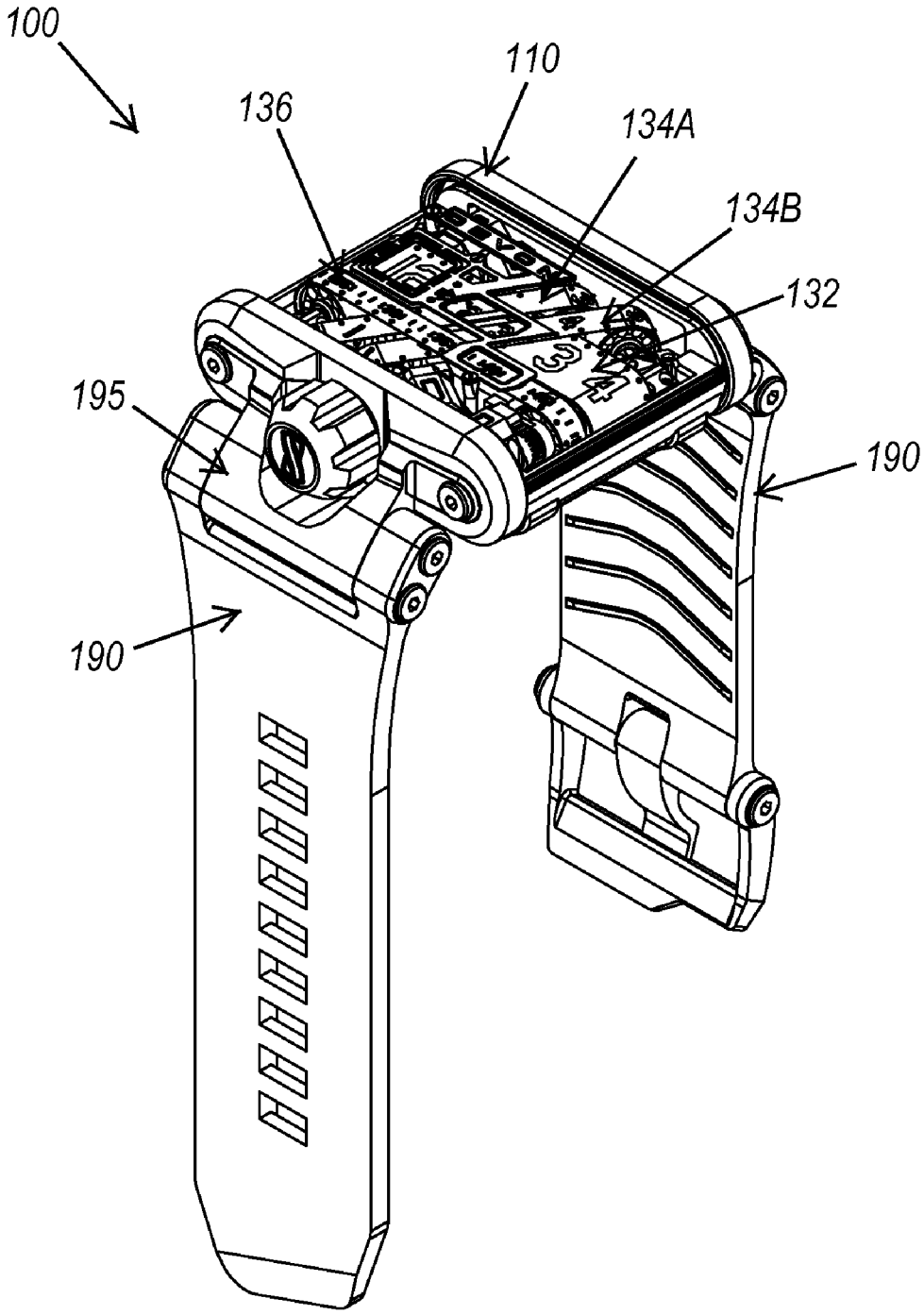
FIG. 12 illustrates a perspective view of the watch of FIG. 11 as assembled.

FIG. 1 depicts one embodiment of the watch assembly 100 having a plurality of time-coordinated belts 132, 134*a, b*, and 136. The watch assembly 100 generally comprises a casing 110 and a wristband 190 coupled to the casing 110 via a hinged coupler 195. This can also been seen in FIG. 12.

Casing 110 comprises a display area having a plurality of windows 122, 124*a,b*, and 126 through which an indication of time (hour, minutes and seconds, respectively) may be read. Preferably, the plurality of windows 122, 124*a,b* and 126 provide a fixed and stationary display, although embodiments utilizing a mobile or time-coordinate display may also be implemented.

A plurality of time-coordinated belts 132, 134*a,b* and 136 provide the indication of time through the plurality of windows 122, 124*a,b* and 126. The plurality of time-coordinated belts 132, 134*a,b* and 136 may separately provide an indication of the hour, minutes and seconds, respectively. While an embodiment of the watch has been described and illustrated comprising a belt 136 for the display of seconds, it is to be understood that embodiments of the watch without such belt 136 are within the scope of the invention. Each of the time-coordinated belts 132, 134*a,b* and 136 are configured as an endless loop around drum pairs, as further explained and depicted in FIGS. 3-8. The belts can be formed from suitable materials that provide sufficient flexibility to conform with the respective drum pairs without stretching to maintain a desired fit. In an example embodiment, the belts are formed from a fiber-reinforced polymeric material, such as nylon or the like, and have a thickness that provides a desired degree of conformity. In an example embodiment, the belts have a thickness of approximately 0.002 inches.

Figure 9:
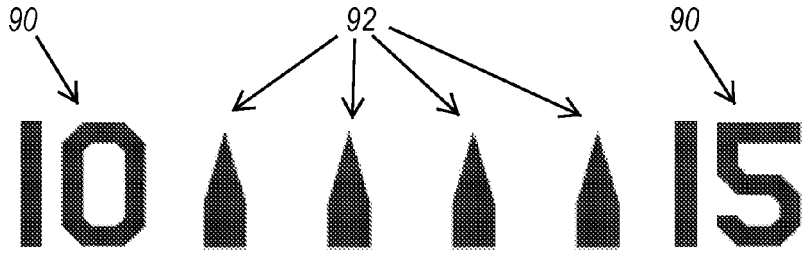
FIG. 9 illustrates a combination of a numerical and representative indication of time that may be provided on a time-coordinated belt.

As shown in FIG. 9, the time-coordinated belts 132, 134*a,b* and 136 include printed or otherwise marked indicia along an outside surface, e.g., in the form of consecutive numerals 90 or other alternative representations of numbers or time increments 92, such as tick or dash marks useful for providing a time display. Movement of the time-coordinated belts 132, 134*a,b* and 136 causes these numerals 90 or other alternative representations 92 to appear through the plurality of windows 122, 124*a,b* and 126 to provide an indication of time, i.e., a time display when viewed by a user.

The embodiment depicted in FIG. 1 show at least two of the time-coordinated belts 134*a,b* overlapping another of the time-coordinated belts 132 at an angle that is not perpendicular to the axis of the overlapped belt 132. This overlapping and angled arrangement of the belts 132 and 134*a,b* allows for the numerals corresponding to the separate time aspects (hour and minutes) to appear in close proximity with each other and further provides a novel display of the time.

An optional indication of date (not depicted) may be provided in a different or similar manner. For example, the indication of date may be provided as a digital display separate from the plurality of time-coordinated belts. The indication of date may also be provided as an analog display, either similar or different from the indication of time as provided by the belts.

A crown 185 is provided to enable a user to set or adjust the time set for the watch assembly 100 by rotating any one or more of the plurality of time-coordinated belts 132, 134*a,b* and 136. In accordance with one aspect of the preferred embodiment, the crown 185 may be pulled in a direction away from the watch casing 110 in at least three stepped distances, each of which separately corresponds to the adjustments of the hour, minutes and seconds. The crown 185 may be turned to rotate each of the plurality of belts 132, 134*a,b* and 136 in either one of two directions to rotate the numbers in an increasing or decreasing order through the windows 122, 124*a,b* or 126. Once the desired number on the belts is displayed through the appropriate window, the crown 185 may be further pulled out to adjust additional time parameters (e.g., minutes or seconds) in similar manner. Once the time adjustment is completed, the crown 185 may be pushed in to set the time. Alternatively, all of the time adjustments can be made by turning the crown in one or more directions.

In a preferred embodiment, the crown 185 is associated with a delay function to prevent undesired advancement of the belts. The crown 185 may thus be turned in either direction, in any amount of degrees for a set period of time before the belts begin to advance for the purpose of setting the correct desired time. The crown can be positioned at different locations on the watch. In the example embodiment illustrated in FIG. 1, the crown 185 is positioned extending from the casing 110 adjacent one of the watch wristbands 190, i.e., parallel with the wristband. In such embodiment, the hinged coupler 195 comprises a recessed portion for accommodating the crown therein.

The crown 185 may be coupled to a circuit-switch, which allows for the crown to be turned and held at a certain set degree of rotation. For example, clockwise rotation may advance either one of the hour belt or the minute belt and counter-clockwise rotation may advance the other of the hour belt or the minute belt that was not advanced by clockwise rotation. The seconds belt 136 is preferably halted during the operation of all crown functions. Upon disengagement of the crown functions, the seconds belt 136 may advance to depict accurate current seconds reading and subsequent continue its normal advancement. Additionally, the watch can be turned on and/or off by operation of the crown.

Figure 2:
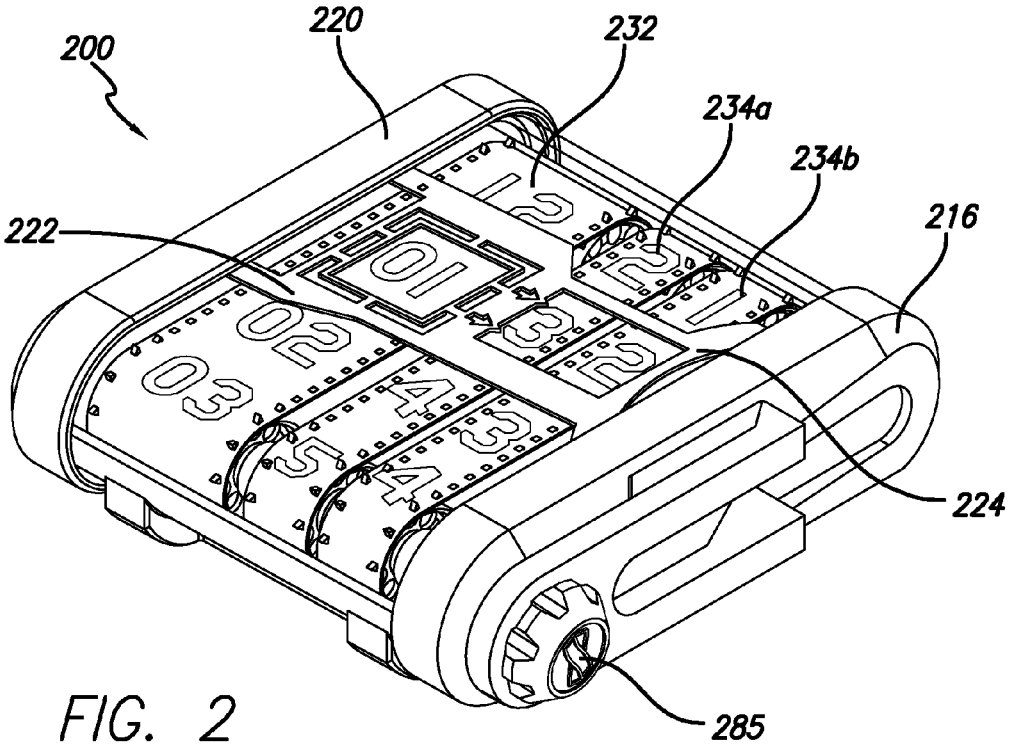
FIG. 2 is a perspective view of another embodiment of a wrist watch having a plurality of time-coordinated belts.

FIG. 2 depicts another embodiment of the watch assembly 200 having a casing 210 that comprises a display area 220 and a plurality of time-coordinated belts 232 and 234*a,b*. Although not depicted in this embodiment, it is understood that the watch assembly 200 may further comprise a wristband coupled to the casing via a hinged coupler in a similar manner as depicted in FIG. 1.

The display area 220 preferably comprises a transparent window made of glass, plastic, acrylic or other suitable material. A plurality of windows 222, 224 may be defined with a separate frame or may be demarcated by suitable graphics provided directly on the display area 220, such as markings or the like. Alternatively, the display area 220 may be made of opaque material with one or more windows 222, 224 as defined by a transparent portion of the opaque material.

The plurality of windows 222, 224 is provided in connection with the display area 220 through which an indication of time may be read by a user. In the embodiment depicted in FIG. 2, the hour and minutes may be read through windows 222 and 224 respectively. While the plurality of windows 222, 224 are depicted in FIG. 2 as being stationary or fixed to the display, it is understood that the windows 222, 224 may also be slidably mobile.

A plurality of time-coordinated belts 232 and 234*a,b* provide the indication of time through the plurality of windows 222 and 224*a,b*, respectively. The plurality of time-coordinated belts 232 and 234*a,b* separately provide an indication of the hour, minutes and optionally seconds (not shown). Each of the time-coordinated belts 232 and 234*a,b* are also configured as an endless loop around drum pairs. Consecutive numerals are provided on the time-coordinated belts 232 and 234*a,b* and movement of the time-coordinated belts 232 and 234*a,b* causes these numerals to appear through the plurality of windows 222 and 224*a,b* to provide an indication of time. Unlike the embodiment of the watch assembly 100 depicted in FIG. 1, the plurality of time-coordinated belts 232 and 234*a,b* are arranged in a non-overlapping and substantially parallel manner.

A crown 285 is provided to enable a user to set or adjust the time set for the watch assembly 200 by rotating any one or more of the plurality of time-coordinated belts 232 and 234*a,b*. In accordance with one aspect of the preferred embodiment, the crown 285 may be pulled in a direction away from the watch casing 210 in two or more stepped distances, each of which separately corresponds to the adjustments of the hour and minutes. The crown 285 may be turned to rotate each of the plurality of belts 232 and 234*a,b* in either one of two directions to rotate the numbers in an increasing or decreasing order through the windows 222. Once the desired number on the belts is displayed through the appropriate window, the crown 285 may be further pulled out to adjust additional time parameters or may be pushed in to set the time.

Figure 3A:
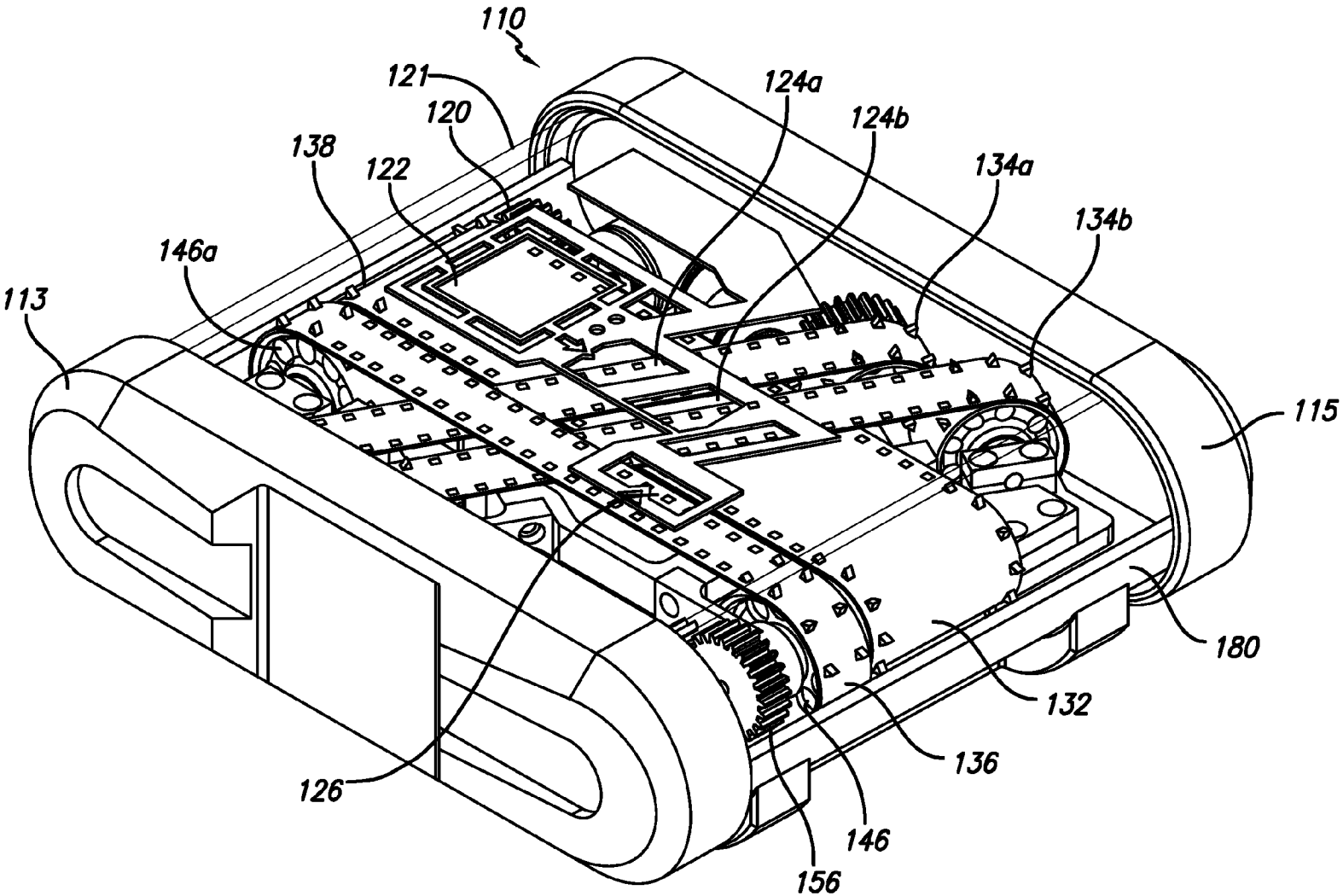
FIGS. 3A-B are perspective views of the casing portion of the watch assembly of FIG. 1.
Figure 3B:
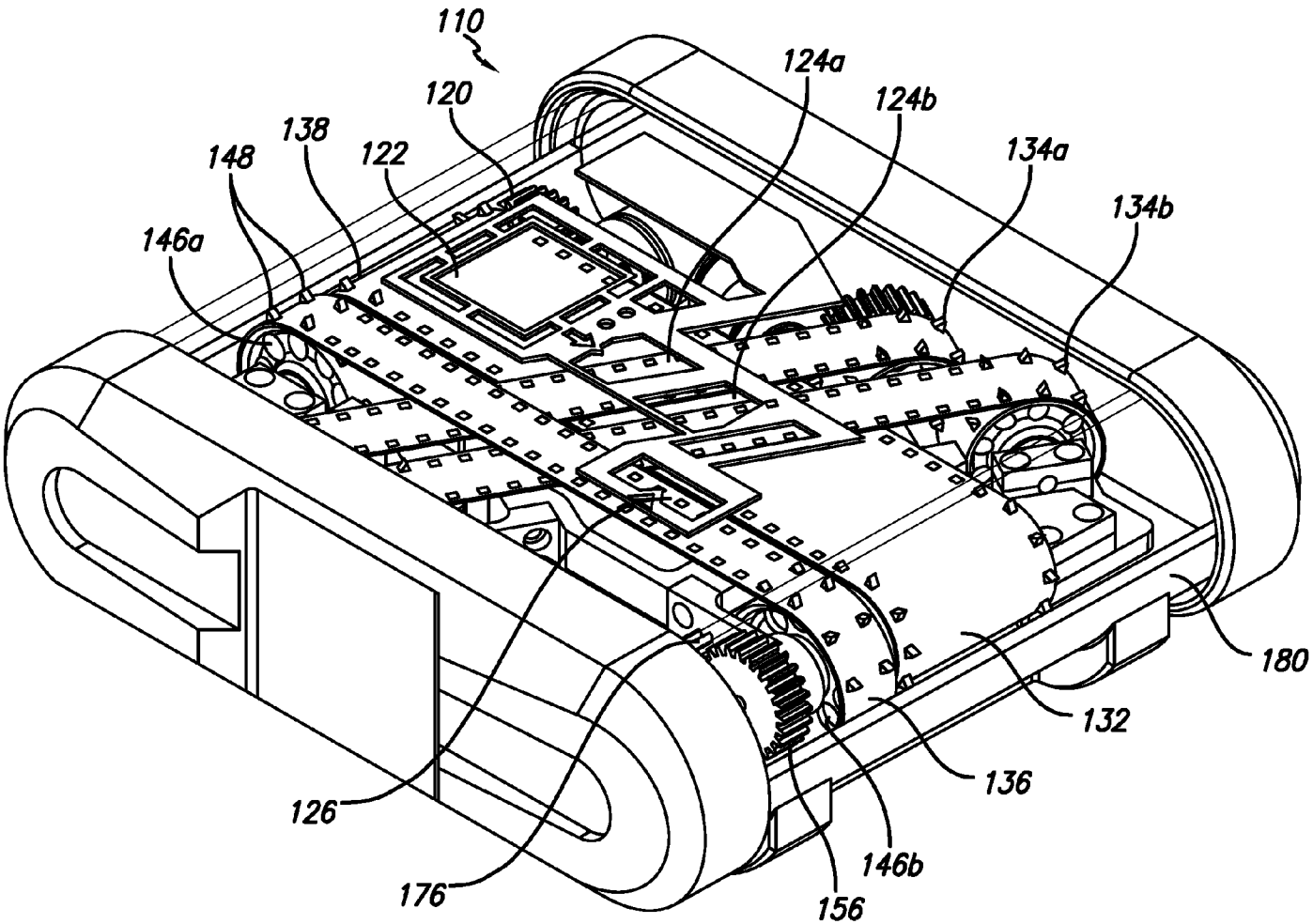

FIGS. 3A-B are perspective views of the casing portion 110 of the watch assembly 100 of FIG. 1. As further shown in FIGS. 3A-B, the casing portion 110 comprises a lower end cap 113 and an upper 115 end cap and a display area 120 defined therebetween. The display area 120 is covered with a front cover 121, wherein at least a portion of the cover is transparent. In an example embodiment, the entire cover is transparent to facilitate viewing the time display as well as other operative features of the watch. The front cover can be front cover is preferably made of a transparent material, such as glass, plastic, acrylic and the like. In an example embodiment, the front cover is made from scratch-resistant and anti-reflective polycarbonate of the same type used to make bulletproof glass and the like.

A single plate, display template or frame 120 is provided with a window indication of hour 122, minutes 124*a,b* and seconds 126. While a single plate 120 is depicted in FIG. 1, it is understood that the plurality of windows 122, 124*a,b* and 126 may be provided on separate plates. Alternatively, instead of having a separate plate, the windows may simply be marked directly on the display area 120 and/or on the front cover of the watch assembly 100 with suitable graphics or annotations.

Figure 10A:
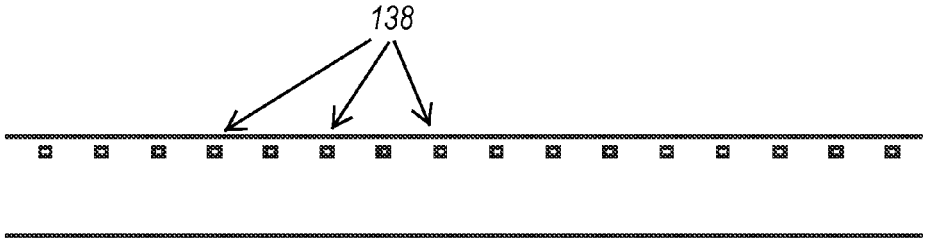
FIG. 10A illustrates a segment of a time-coordinated belt having a plurality of grooves on a single side.
Figure 10B:
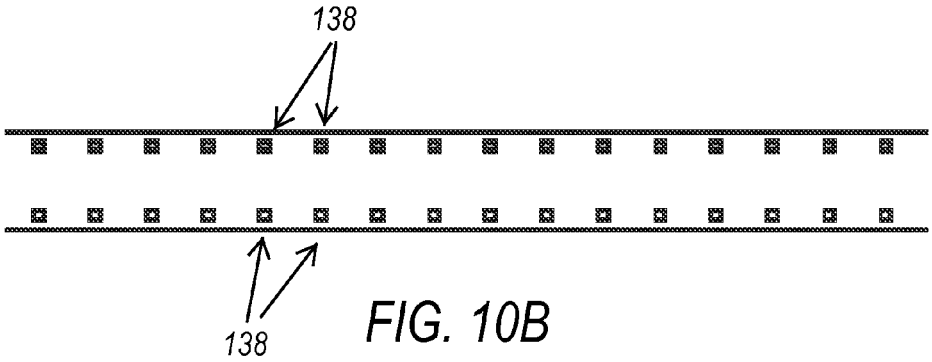
FIG. 10B illustrates a segment of a time-coordinated belt having a plurality of grooves on both sides the belt.

A plurality of belts 132, 134*a,b* and 136 are each disposed on drum pairs, the plurality of belt 132, 134*a,b* each having sequential numerals printed or otherwise provided on the surface (not shown). The plurality of belts 132, 134*a,b* are each disposed on opposing drum pairs by a plurality of openings or grooves 138 which line the outer periphery and which mate with corresponding surface features such as spikes or protrusions 148 provided on the drum pairs. The plurality of grooves 138 may be provided on one side of the belt, as shown in FIG. 10A, or on both sides of the belt, as shown in FIG. 10B. Spikes or protrusions 148 are provided on drum pairs corresponding to the location of the plurality of grooves 138 on the belts to provide a secure engagement therebetween to avoid unwanted belt slippage.

A frame or chassis 180 is disposed within the casing portion 110 and supports at least a portion of the movement mechanism or assembly that is responsible for causing the time-coordinated movement of the belts 132, 134*a,b* and 136 relative to the windows 122, 124*a,b* and 126. The chassis is attached to the case and is interposed between the upper and lower end caps 113 and 115, and between a front side and back side surface of the case.

Figure 4A:
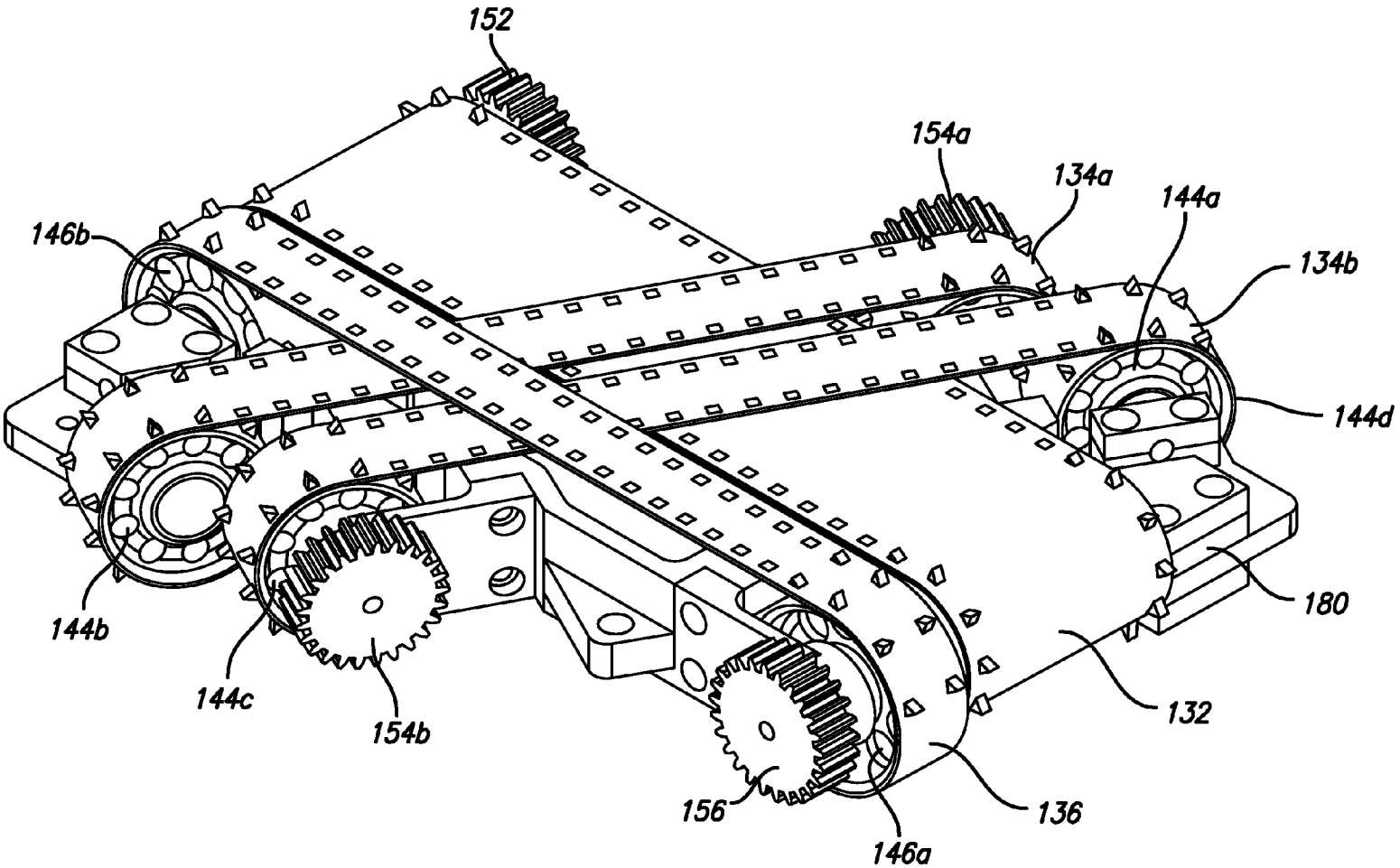
FIGS. 4A-B are perspective views of the belt assembly for the watch assembly of FIG. 1.
Figure 4B:
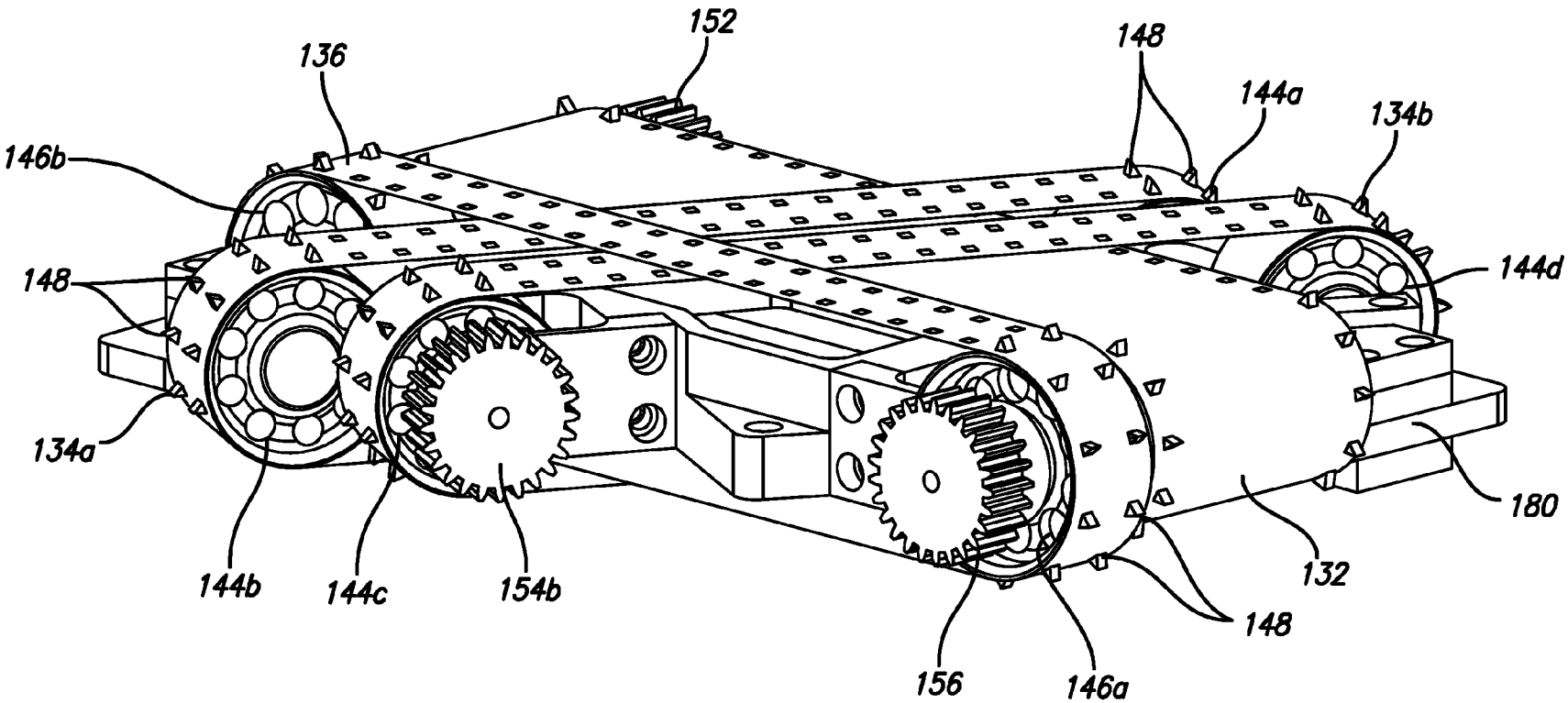

FIG. 4A-B further depicts the belt-assembly portion of the movement mechanism for the watch assembly 100. Frame 180 supports the belt-assembly portion, which comprises pairs of opposing drum cylinders for each of the plurality of time-coordinated belts. As previously explained, each of the time-coordinated belts 132, 134*a,b* and 136 correspond to the hour, minutes and seconds, respectively and are configured as an endless loop. As further shown in FIGS. 5-7, the hour belt 132 is looped around drum pair 142*a,b* and the seconds belt 136 is looped around drum pair 136*a,b*. Although watch assembly 100 depicts the indication of minutes in two separate belts 134*a,b*, each of which is configured to display a single digit, it is understood that the indication of minutes may be provided in a single belt, in like manner as for the hour and seconds. In the embodiment depicted in FIGS. 1, 4-8, each of the two minute belts 134*a,b* is looped around drum pairs 134*a,b* and 134*c,d* and separately actuated. The drums are each rotatably attached to the frame. In an example embodiment, bearings or the like can be provided at the rotation points to ensure a desired low friction connection between the drums and the frame.

A plurality of grooves or openings 138 are provided along the outer periphery of each of the plurality of belts 132, 134*a,b* and 136. The plurality of grooves 138 are configured to match or mate with the plurality of spikes 148 or protrusions which are disposed along the circumference of the drum pairs on which the belts are disposed. The grooves 138 and spikes 148 allow for the precise movement of each of the belts without slipping such that the intended numeral is accurately displayed through the windows.

In an alternative embodiment, each of the plurality of belts 132, 134*a,b* and 136 may be provided with a tacky underside surface that contacts the drum pairs so as to prevent slippage. In another alternative embodiment, the drum pairs may also have a tacky surface contacting the plurality of belts 132, 134*a,b* and 136.

Figure 5:
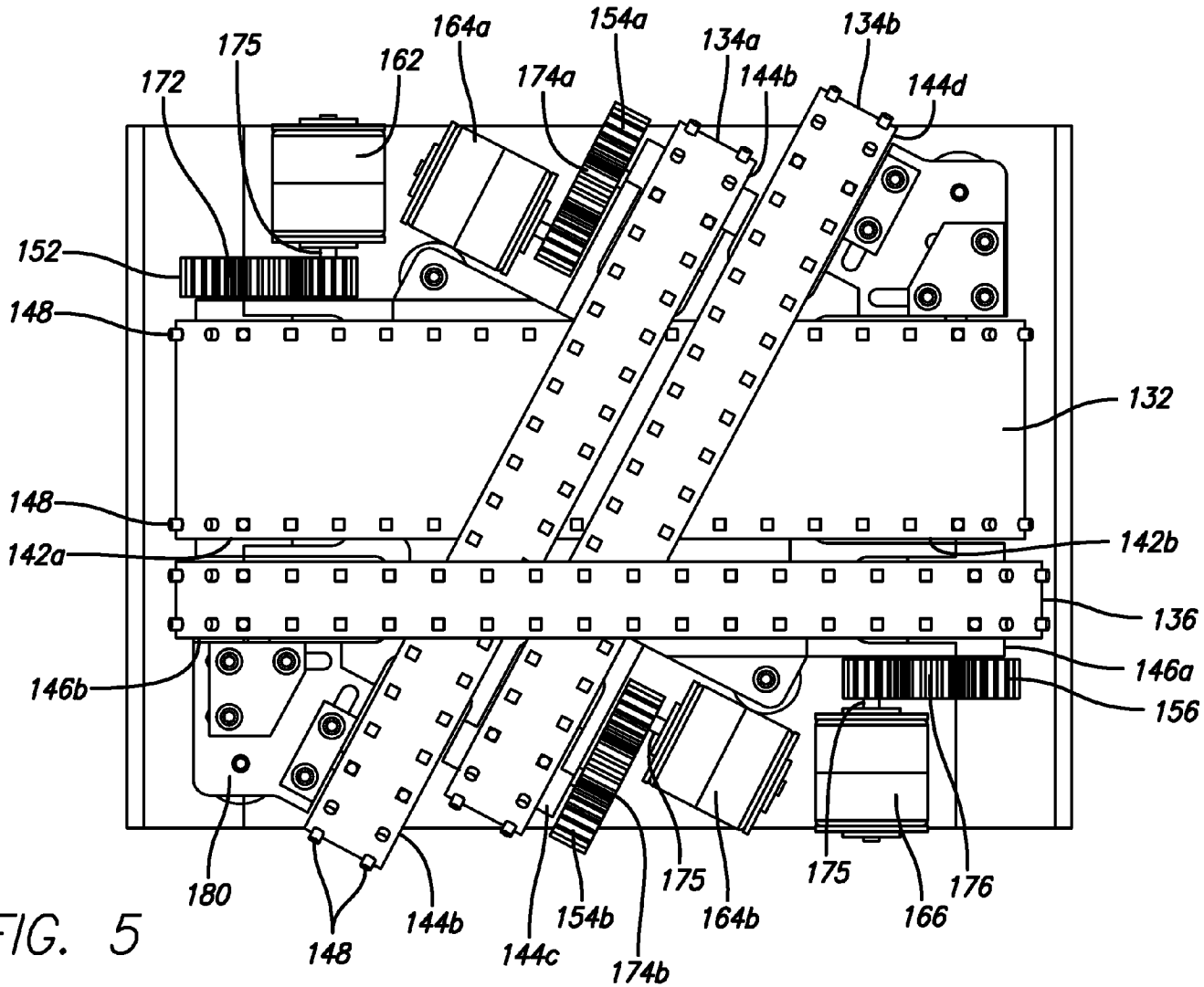
FIG. 5 is a top plan view of the casing portion of the watch assembly of FIG. 1.

FIG. 5 is a top plan view showing the movement mechanism of the watch assembly 100 with the plurality of time-coordinated belts 132, 134*a,b* and 136. The movement of the belts 132, 134*a,b* and 136 are each controlled by a plurality of motors 162, 164*a,b* and 166, respectively. In an example embodiment, the motors that are used are stepper motors. The motors 162, 164*a,b* and 166 rotate associated drive gears 172, 174*a,b* and 176 coupled to the motors 162, 164*a,b* and 166 via drive shafts 175. The motors are attached to the case and when the frame is disposed within the case that motor drive gears engage respective drum gears 162, 164*a,b* and 166 that are attached to respective drums 152*a*, 154*a,c* and 156*a*. Thus, rotation of the drive gears 172, 174*a,b* and 176 cause the rotation of drum gears 162, 164*a,b* and 166 coupled to drums 152*a*, 154*a,c* and 156*a*, respectively. The rotation of the drum gears 162, 164*a,b* and 166, in turn, causes the rotation of the associated drums 152*a*, 154*a,c* and 156*a* to advance the belts 132, 134*a,c* and 136 and thus the numerals that are displayed through the windows 122, 124*a,b* and 126 of the display 120.

In an example embodiment, the motors for driving the hours and minutes belts may be operated in a noncontinuous manner, to provide a stepped change in hours and minutes, while the motor for driving the second belt is operated continuously to provide a constant update in second time display.

Figure 6:
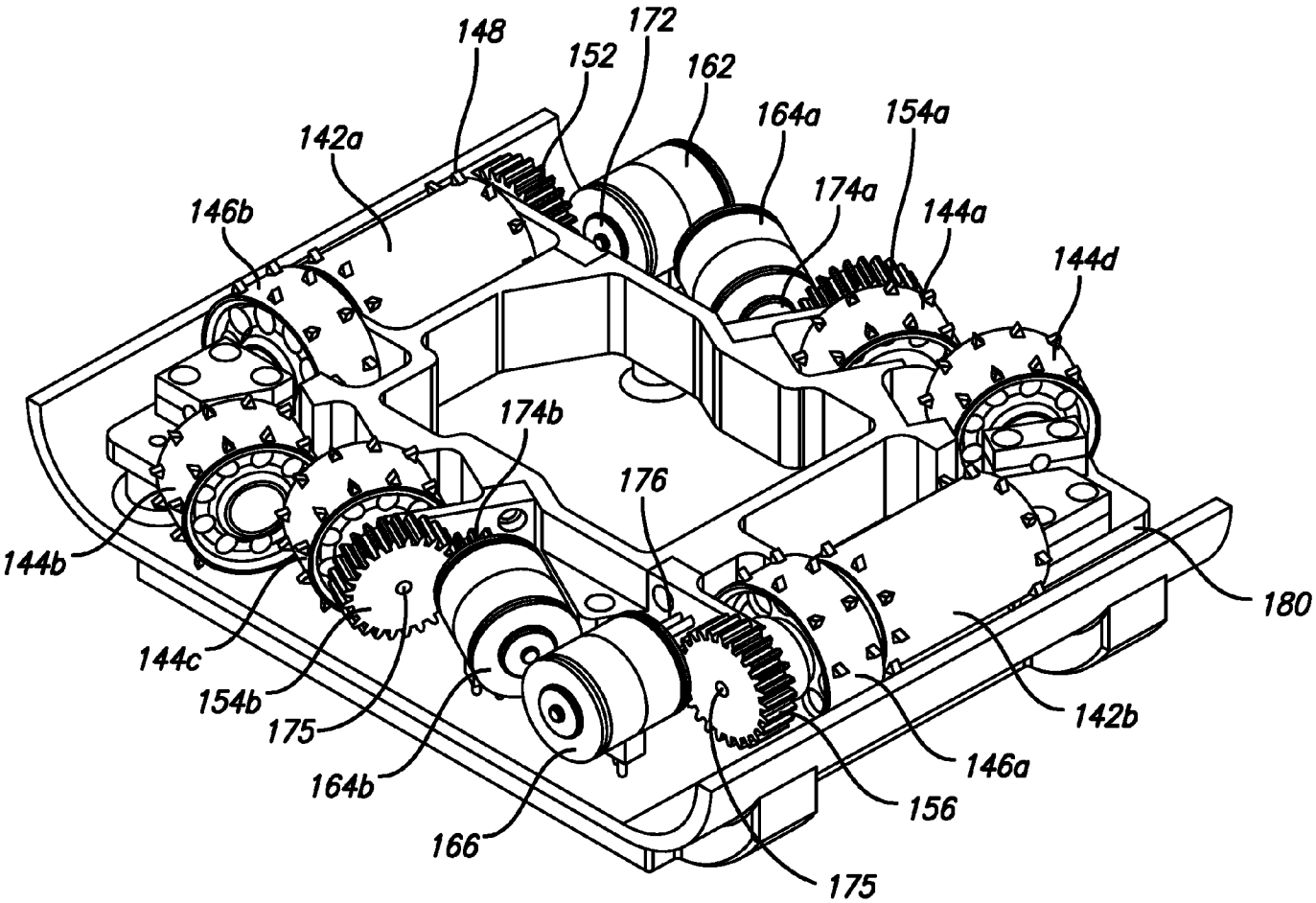
FIG. 6 is a perspective view of the casing portion of the watch assembly of FIG. 1 without the belts.
Figure 7:
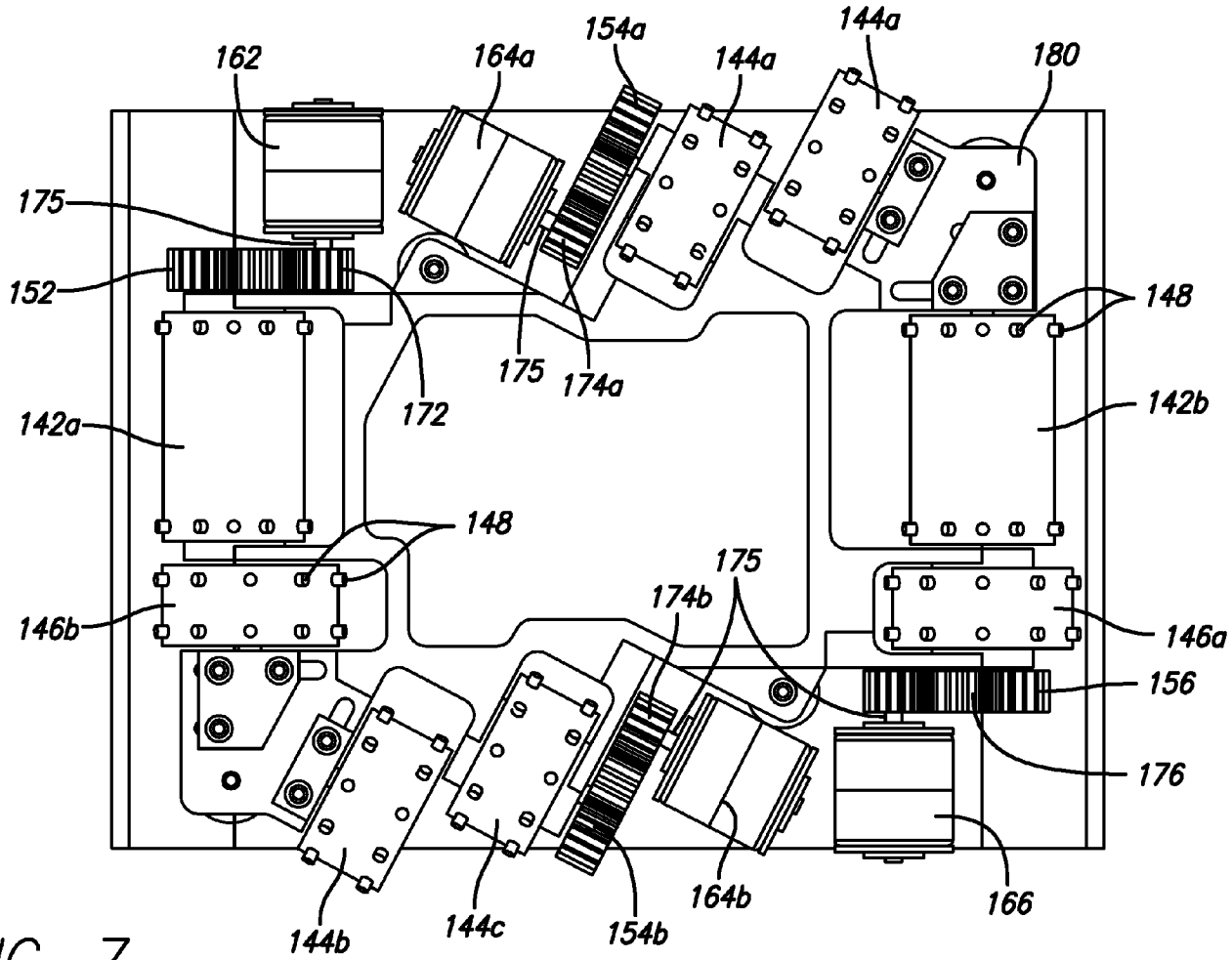
FIG. 7 is a top plan view of the casing portion of the watch assembly of FIG. 1 without the belts.

The arrangement of the movement mechanism is more clearly depicted in FIGS. 6-7, which depict the arrangement of the various components (e.g., motor, drive shaft, drive gear, drum gear, drum pairs) without the plurality of belts. While the embodiment of the watch assembly 100 depicts separate motors for each of the belt assemblies, it is understood that a single motor may be provided to control the movements of the one or more of the belt assemblies.

Figure 8:
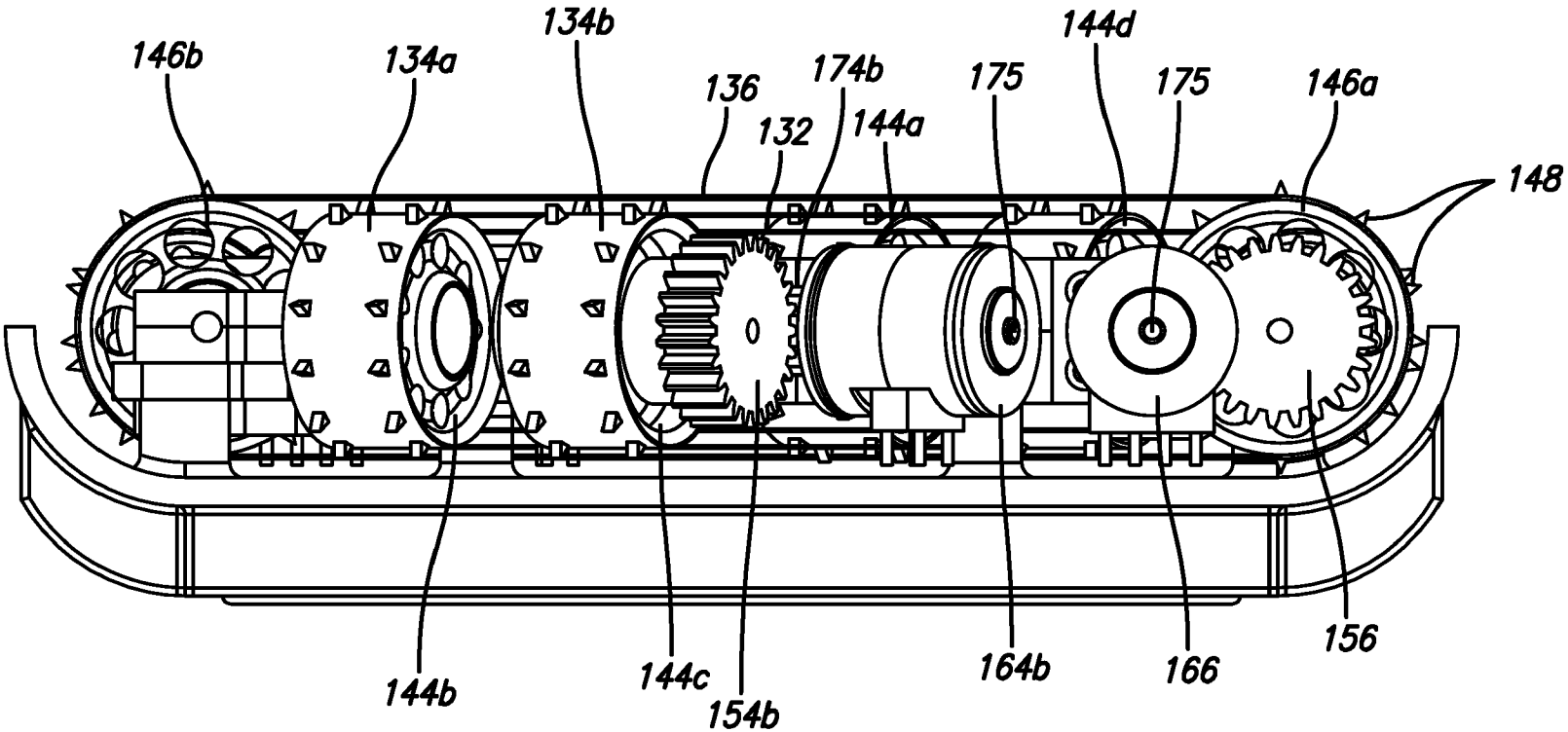
FIG. 8 is a bottom end view of the casing portion of the watch assembly of FIG. 1.

FIG. 8 is a bottom end view of the casing portion of the watch assembly 100. As shown in FIG. 8, the plurality of time-coordinated belts 132, 134*a,b* and 136 are arranged in a spaced-apart arrangement relative to one another. In a preferred embodiment, contact between the surface of the belts 132, 134*a,b* and 136 is minimized or completely avoided so as to minimize the wear and tear of the moving components of the watch assembly 100. In the embodiment depicted herein, the parallel minute belts 134*a,b* overlap parallel hour belt 132 and seconds belt 136. In order to avoid the minute belts 134*a,b* from contacting the surface of the hour belt 132 and seconds belt 136, the drums 144*a-d* corresponding to the minute belts 134*a,b* may have a larger diameter than the drums 142*a,b* for the hour belt 132 and the drums 146 of the second belt. Alternate arrangements for overlapping the various belts may be provided by manipulating the diameter of the drum pairs so as to provide a spaced apart relation between the belts. The plurality of belts may further be provided in angular relationship with one another so as to increase the display options.

Figure 11:
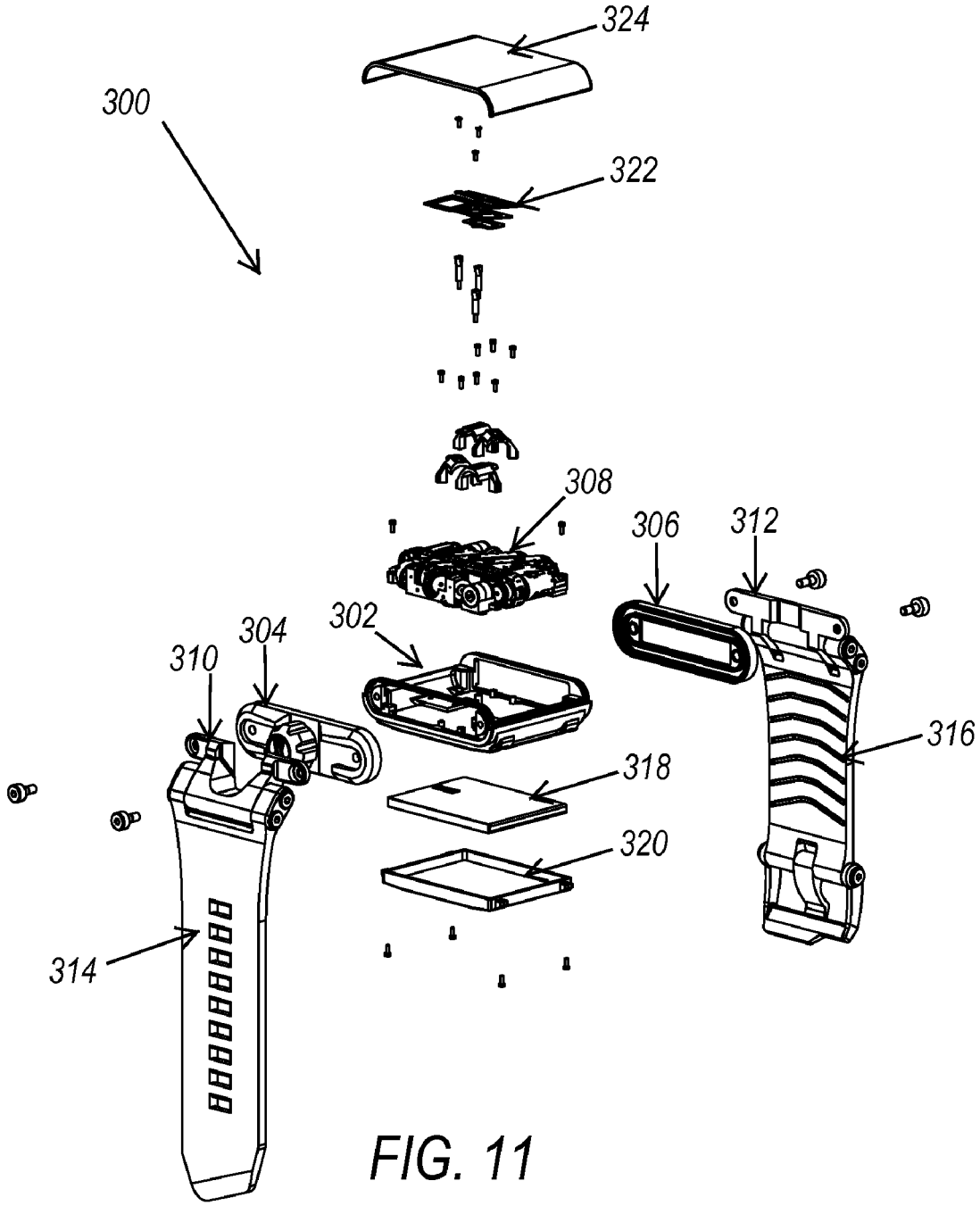
FIG. 11 illustrates an exploded view perspective of the various elements making up the watch.

FIG. 11 shows the watch 300 in a disassembled state comprising the case or casing 302, the end caps 304 and 306, the movement mechanism or assembly 308, the hinged wristband couplers 310 and 312, the wristbands 314 and 316, a power source or battery pack 318, a bottom cover 320, a display window, frame or template 322, and a front cover or clear crystal 324. As illustrated, the case can be referred to as comprising a 5-piece assembly made up of the central case 302, the two end caps 304 and 306, and the two wristband couplers 310 and 312. The case assembly can be made from any rigid material, and is preferably made from a metallic material. In an example embodiment, the case assembly is made from stainless steel.

Figure 13:
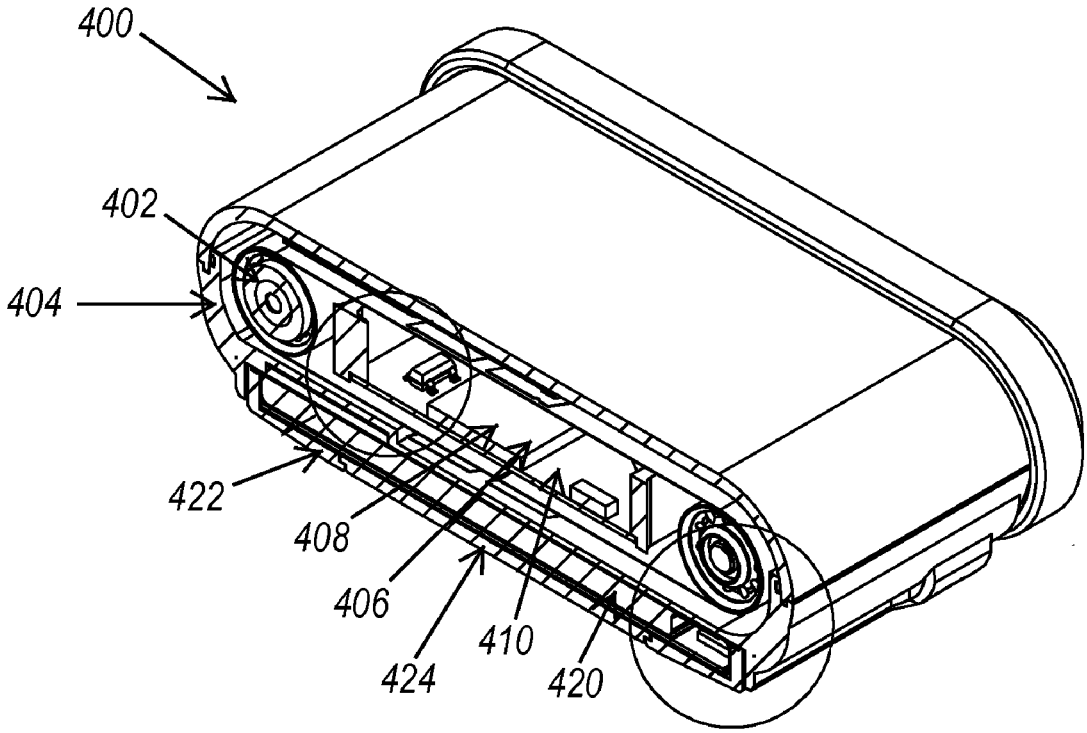
FIG. 13 illustrates a perspective cross-sectional view of the watch illustrating the location of control circuitry and a power source.

FIG. 13 illustrates a sectional view of the watch 400 with the movement mechanism 402 as installed in the case 404. The watch includes a control mechanism 406 comprising a microcontroller or microprocessor 408 that is electrically connected to a circuit board 410. The control mechanism is positioned in a cavity within the frame that exists within the belt and drum assemblies. The microprocessor is configured to perform the desired time keeping and other functions of the watch, and receives data from a quartz crystal also mounted on the circuit board for operating the motors to provide the desired time display function. In an example embodiment, the quartz crystal is temperature compensated to ensure accurate time keeping.

In an example embodiment, the watch include means for monitoring the position of the belts. In a preferred embodiment, such means is provided by an optical recognition system that uses an infra-red sensor to view a white spot on the belt to monitor and track belt positioning. This information is provided to the microprocessor for purposes of moving the belts as necessary to provide and/or maintain an accurate time display. In an example embodiment, the optical recognition system operates to calibrate belt positioning every time the watch is turned on.

A battery pack 420 is disposed within the case 404 at a position beneath the movement mechanism 402. In an example embodiment, the battery pack is interposed within a cavity of the case between the movement mechanism and a back cover 422. The back cover 422 is configured having a nonmetallic portion 424 to facilitate wireless or induction charging a rechargeable battery in the battery pack.

Figure 14A:
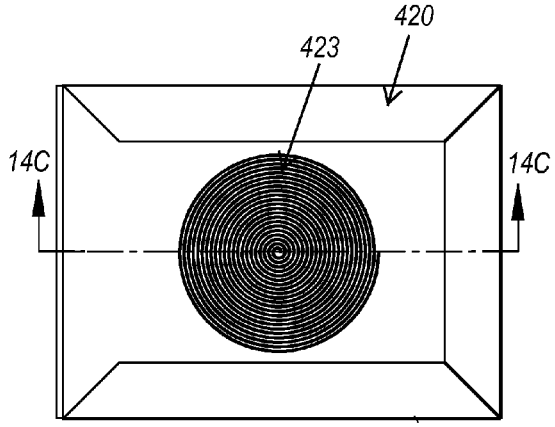
FIGS. 14A-C illustrate different views of a battery pack used to power the watch.
Figure 14B:
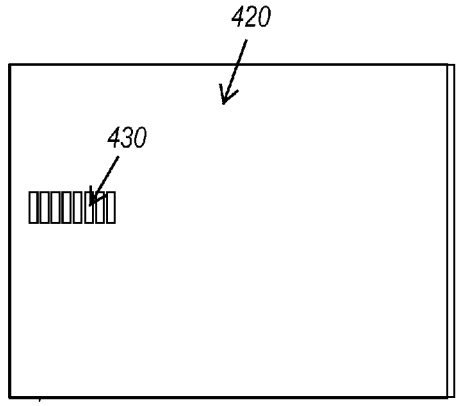
Figure 14C:
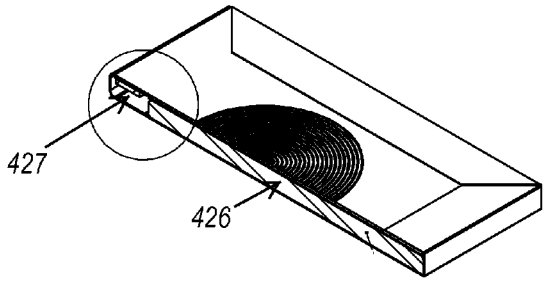

FIGS. 14 A-C illustrate the battery pack 420 used to power the watch. In an example embodiment, the battery pack comprises a rechargeable battery 426, and in a preferred embodiment comprises a lithium ion battery. The battery pack is configured to include elements useful for facilitating the wireless recharging of the battery. In an example embodiment, the battery pack is configured to work with a separate charging station to facilitate wireless charging of the battery by placing the watch in close proximity to the charging station, which can be configured in the form of a mat or other structure useful for accommodating placement of the watch thereon or therein.

In an example embodiment, the charging station provides a stable frequency that is produced with an oscillator which drives an LC between it and the watch wirelessly. The LC circuit is designed to be in resonance when the watch is placed in close proximity to the charging station, and off resonance when the watch is removed. NMF between the coil effects charging. The resonant circuit creates a magnetic field that penetrates the nonmetallic portion of the watch back cover. The battery pack is configured to include components 427 that receive the magnetic energy and complete the resonant circuit.

The battery pack includes a receiving coil 428 that is disposed on a back surface of the battery. The battery pack also includes a rectifying circuit, a filter circuit, and a regulator that are each disposed within a cavity in the battery pack adjacent the battery. A charging circuit is disposed within the watch and is electrically connected with the circuit board 410. The battery pack includes electrical connections 430 on a front surface of the battery that is electrically connected with the battery. The battery pack is placed within the watch with the front surface adjacent the movement mechanism to facilitate engagement of the electrical connections with the circuit board to provide the necessary power to the microprocessor and other elements of the watch.

When the watch is placed in close proximity to the charging station or a charging surface, the coil in the battery pack completes a resonant circuit and an AC voltage is produced in the watch. This AC voltage is turned into a DC current which is then filtered and regulated within the battery pack. The regulated DC current is connected to the charging circuit in the watch electronics board through the electrical connections. The charging current is passed back to the battery pack through the connector and charges the battery. When the watch is removed from the charging surface, the charging circuit reverts to a state that is off resonance and it consumes a minimum amount of energy. In an example embodiment, after recharging, the watch can operate for a period of 2 or more weeks.

Having thus described embodiments of the watch assembly having a plurality of time-coordinated belts, it should be apparent to those skilled in the art that certain advantages of the adjustable exercise assembly have been achieved. It should also be appreciated that various modifications, adaptations, and alternative embodiments thereof may be made within the scope and spirit of the present invention.

What is claimed:

1. A portable timepiece comprising:

a casing;

a number of continuous belts disposed within the casing, wherein the belts include indicia on an outer belt surface, and wherein the belts are rotated within the case to provide a time display; and a front cover disposed over a front portion of the casing, wherein at least a portion of the front cover is transparent, and wherein the indicia on the number of belts is visible through the front cover to provide a time display and wherein the continuous belts are arranged to overlap such that the time display is provided over a path of at least one of the belts.

2. The portable timepiece as recited in claim 1 comprising a display frame comprising one or more windows for viewing respective belt indicia therethrough to provide a time display.

3. The portable timepiece as recited in claim 1 wherein the casing comprises opposed end caps that extend from the front surface to a case back surface, wherein timepiece further comprises wrist bands operatively connected with respective end caps to facilitate removably attaching the timepiece to a user.

4. The portable timepiece as recited in claim 1 wherein each belt is disposed around a respective pair of opposed belt drums to facilitate rotation of the belt, wherein the belts and respective drums are disposed on a frame attached to the case, and wherein the watch include one or more motors operatively connected with one or more belt drums to rotate the belts.

5. The portable timepiece as recited in claim 4 wherein the belt drums include surface that register with a respective belt to provide a nonslip engagement therebetween.

6. The portable timepiece as recited in claim 1 further comprising a microcontroller disposed within the case for controlling movement of the belts to provide a time display.

7. The portable timepiece as recited in claim 1 further comprising a power source disposed within the case and comprising:

a rechargeable battery;

a wireless charging induction coil; and charging circuitry.

8. The portable timepiece as recited in claim 1 wherein the belts comprise:

a first belt that includes numerical indicia for providing an hour time display; and a pair of second belts that each includes numerical indicia for together providing a minute time display.

9. The portable timepiece as recited in claim 8 wherein one of the first or second belts overlap the other of the first or second belts.

10. The portable timepiece as recited in claim 8 wherein the belts further comprise a third belt that includes numerical indicia for providing a second time display.

11. The portable timepiece as recited in claim 8 comprising four motors, wherein a first motor is operatively connected to a first belt having numerical indicia for providing a hour time display, wherein a second and a third motor are operatively connected to respective second and third belts having numerical indicia for together providing a minute time display, and wherein a fourth motor is operatively connected to a fourth belt having numerical indicia for providing a second time display.

12. The portable timepiece as recited in claim 1 further comprising an optical sensor for detecting the position of one or more belts.

13. The portable timepiece as recited in claim 1 wherein a substantial portion of the belts independent of the indicia providing the time display is visible through the front cover.

14. A timepiece for providing a digital time display comprising:

a case having a transparent front cover for viewing a time display;

a plurality of continuous belts rotatably disposed within the case, the belts comprising:

a first belt having a numerical indicia on a surface to provide an hour time display, and a pair of second belts having numerical indicia on their surface to when combined provide a minute time display;

one or more windows positioned adjacent the belts to register with the indicia of the combined first and second belts to provide an hour and minute time display and wherein the continuous belts are arranged to overlap such that the time display is provided over a path of at least one of the belts.

15. The timepiece as recited in claim 14 wherein the belts are each disposed between opposed respective drums, and the drums are rotatably mounted to a frame separate from the case.

16. The timepiece as recited in claim 15 further comprising one or more motors that are operatively coupled to the drums to move the belts to provide the time display.

17. The timepiece as recited in claim 16 wherein each belt is driven by a separate motor.

18. The timepiece as recited in claim 16 comprising a microcontroller disposed within the case for controlling the operation of the motors to move of the belts to provide the time display.

19. The timepiece as recited in claim 16 comprising a power source disposed within the case for operating the motors.

20. The timepiece as recited in claim 19 wherein the power source comprises a rechargeable battery, and wherein the timepiece comprises means for wirelessly recharging the battery.

21. The timepiece as recited in claim 19 wherein the windows are provided in a display frame that is interposed between the front cover and the belts.

22. The portable timepiece as recited in claim 14 wherein a substantial portion of the belts independent of the indicia providing the time display is visible through the front cover.

23. A timepiece for providing a digital time display comprising:

a case having a transparent front cover for viewing a time display;

a plurality of continuous belts rotatably disposed within the case, the belts comprising:

a first belt having a numerical indicia on a surface to provide an hour time display, and a pair of second belts having numerical indicia on their surface to when combined provide a minute time display;

wherein the first and second belts are disposed over respective opposed drums, and wherein each belt is driven by a motor coupled to a respective drum;

one or more windows positioned adjacent the belts to register with the indicia of the combined first and second belts to provide an hour and minute time display and wherein the continuous belts are arranged to overlap such that the time display is provided over a path of at least one of the belts.

24. The timepiece as recited in claim 23 wherein the belts and drums are disposed on a frame, and the frame is attached to the case.

25. The timepiece as recited in claim 23 further comprising a microcontroller for operating the motors to move the belts to provide a time display.

26. The timepiece as recited in claim 23 further comprising a battery for powering the motors, the timepiece further comprising means for wirelessly charging the battery.

27. The timepiece as recited in claim 23 further comprising an optical sensor for detecting the position of the belts for providing a time display.

* * * * *